US005980029A

United States Patent [19]

Hayao

[11] Patent Number: 5,980,029

[45] **Date of Patent: *Nov. 9, 1999**

[54] INK REFILLING ASSEMBLY

[75] Inventor: Sakae Hayao, Chatsworth, Calif.

[73] Assignee: Mitsubishi Pencil Corporation of America, Chatsworth, Calif.

[ * ] Notice: This patent is subject to a terminal disclaimer.

[21] Appl. No.: 08/673,294

[22] Filed: Jun. 28, 1996

[51] Int. Cl.[6] ..... B41J 2/75

[52] U.S. Cl. ..... 347/85

[58] Field of Search ..... 347/7, 85; 141/375

[56] References Cited

U.S. PATENT DOCUMENTS

| | | | |
|---|---|---|---|
| 4,161,178 | 7/1979 | Genese . | |
| 4,700,202 | 10/1987 | Kuranishi et al. . | |
| 4,999,652 | 3/1991 | Chan . | |
| 5,079,570 | 1/1992 | Mohr et al. | 347/7 |
| 5,280,300 | 1/1994 | Fong et al. . | |
| 5,329,294 | 7/1994 | Ontawar et al. . | |
| 5,454,409 | 10/1995 | McAffer et al. . | |
| 5,595,223 | 1/1997 | Hayao | 141/375 |
| 5,721,576 | 2/1998 | Barinaga | 347/85 |

FOREIGN PATENT DOCUMENTS

| | | | |
|---|---|---|---|
| 6-246926 | 9/1994 | Japan | B41J 3/04 |

*Primary Examiner*—Benjamin R. Fuller
*Assistant Examiner*—Charles W. Stewart, Jr.
*Attorney, Agent, or Firm*—Koda & Androlia

[57] ABSTRACT

An ink refilling adapter to be used for refilling a used ink cartridge with ink from a separate ink container. The ink refilling adapter includes a main plate having a conduit and an ink absorbing sheet attached to the under surface of the adapter, and it further includes an overflow indicator which is a through hole opened in the main plate. Any overflowing ink is absorbed by the ink absorbing sheet and such ink is observed through the overflow indicator, thus giving a sign of the beginning of the overflow of the ink and allowing the ink refilling operation to be stopped immediately.

7 Claims, 2 Drawing Sheets

INK REFILLING ASSEMBLY

BACKGROUND OF THE INVENTION

1. Field of the Invention

The present invention relates to an ink refilling assembly or ink refilling adapter for refilling ink into an ink cartridge installed in ink jet printers.

2. Prior Art

A variety of ink cartridges have been developed for printers which use liquid ink for printing, such as ink jet printers. Some ink cartridges are disposed once ink contained in the cartridges has been depleted, and other ink cartridges may be refilled with ink when ink contained in the cartridges has been depleted.

Typically, a refillable ink cartridge has an inlet which is closed by a plug. A syringe with a needle-like injector may be used to transport ink from a separate ink container into the refillable ink cartridge through the inlet after the plug has been removed. A separate ink container may include an injection nozzle which is attached to the container so that ink can be directly supplied from the container to the refillable ink cartridge.

These prior art ink refilling injectors suffer from some problems. For instance, if the cartridge is transparent, the amount of the ink refilled therein can be observed and, therefore, the ink refilling can be stopped when the cartridge is filled with a proper amount of ink. However, such observation is impossible with a non-transparent ink cartridge. In addition, even though the cartridge is transparent, if the cartridge includes inside thereof an ink absorption material such as cotton or sponge, it is not easy to know the amount of ink refilled. Furthermore, depending upon the condition of the ink absorption material after the ink inside the cartridge has been completely depleted, the amount of ink to be absorbed by the ink absorption material varies. As a result, ink occasionally overflows out of the cartridge and sometimes the ink is not refilled completely.

SUMMARY OF THE INVENTION

Accordingly, it is a primary object of the present invention to provide an ink refilling assembly or an ink refill adapter which facilitates the operation of ink refilling into a used, empty ink cartridge.

It is another object of the present invention to provide an ink refilling assembly or adapter in which an overflow of the ink out of the ink cartridge can be prevented, thus causing the ink refilling task to be performed without causing any contamination.

The objects are accomplished by a unique structure for an ink refilling adapter that can indicate the overflow of the ink out of the ink cartridge, and the unique structure of the present invention is that the ink refilling adapter, which is placed on an ink cartridge, is provided with an ink observation opening and an ink absorbing material on the under surface of the adapter so that the initially overflowing ink is soaked by the ink absorbing material and such ink is seen through the ink observation opening. As a result, ink refilling can be stopped immediately after the observation of the overflow, thus preventing spillage of the ink out of the ink cartridge.

DETAILED DESCRIPTION OF THE PREFERRED EMBODIMENTS

Figure 1:
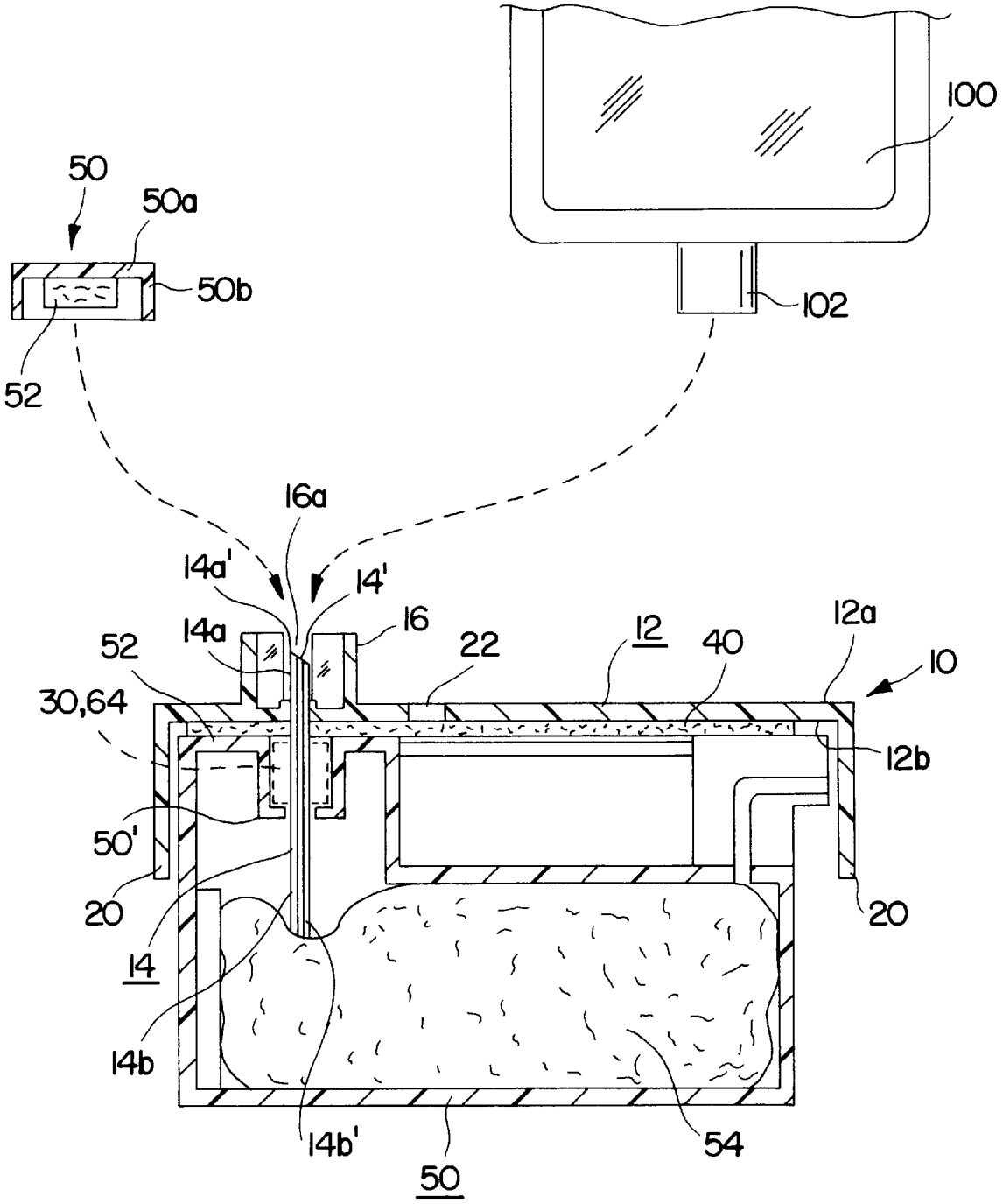
FIG. 1 is a vertical cross sectional view of the ink refilling adapter according to the present invention placed on an ink cartridge with a safety cap removed.
Figure 2:
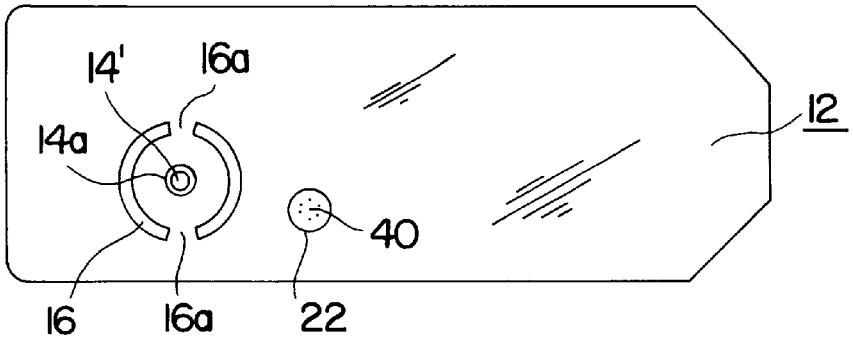
FIG. 2 is a top view of the ink refilling adapter.

As shown in FIGS. 1 and 2, the ink refilling assembly or the ink refilling adapter in accordance with one embodiment of the present invention is generally indicated by reference numeral 10.

The ink refilling assembly 10 comprises a main plate 12 that is typically made of plastic and has substantially the same shape and area as the top wall 52 of an ink cartridge 50. Thus, the main plate 12 can cover the entire upper surface of the top wall 52.

The main plate 12 is provided with a conduit 14 which passes through the main plate 12 at an angle transverse to the main plate 12.

Figure 4:
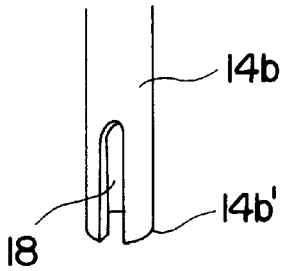
FIG. 4 shows the lower portion of the conduit of the ink refilling adapter.

The conduit 14 is provided near one end of the main plate 12 so as to positionally corresponds to an ink inlet 50' of the ink cartridge 50 when the main plate 12 is placed on the ink cartridge 50. The conduit 14 includes a central bore 14' along with an upper portion 14*a* and a lower portion 14*b* which is opposite from the upper portion 14*a*. The upper portion 14*a* extends from an upper surface 12*a* of the main plate 12 and the lower portion 14*b* extends from a lower surface 12*b* of the main plate 12. Typically, the upper portion 14*a* of the conduit 14 is made of metal and has a sharp end 14*a*'. On the other hand, the lower portion 14*b* of the conduit 14 is formed integrally to the main plate 14 and is long enough so that the end 14*b*' of the lower portion 14*b* can come into contact with the ink absorption material 54 such as cotton, etc. installed inside the cartridge 50 when the adapter 10 is placed on the ink cartridge 50 as best seen from FIG. 1. In addition, as shown in FIG. 4, a longitudinal slit 18 is formed in the lower end area of the lower portion 14*b* of the conduit 14 so as to extend in the axial direction of the conduit 14.

The upper portion 14*a* of the conduit 14 is surrounded by a guide collar 16 which is a cylindrical wall projecting from the upper surface 12*a* of the main plate 12. The guide collar 16 is integrally formed with the main plate 12 and is designed so as to be higher than the upper portion 14*a* of the conduit 14 and has a diameter that can snugly receive the ink outlet 102 of an ink container 100 thereinto. The guide collar 16 is provided with two vertical slits 16*a* so that these slits 16*a* are apart from each other in the diametrically opposite sides.

The main plate 12 of the ink refill adapter 10 is further provided with a side wall 20 that extends on the bottom surface 12*b* side of the main plate 12 for the entire outer edge of the main plate 12. The side wall 20, when the adapter 10 is placed on the ink cartridge 50, positionally secures the adapter 10 on the ink cartridge 50 and prevents the adapter 10 from moving horizontally on the top wall 52 of the cartridge 50.

Furthermore, an ink observation opening 22 is provided in the main plate 12. Typically, the ink observation opening 22 is a round through hole and provided adjacent to the guide collar 16 as seen from FIGS. 1 and 2. One example of the ink observation opening is a 3/16" diameter hole when the main plate has the size of 2 and 23/36" long by 1 and 5/32" wide so that the opening 22 is not too small and not too large compared to the main plate 12. The shape of the observation opening 20 is not limited to be round and can be in any shape.

Figure 3:
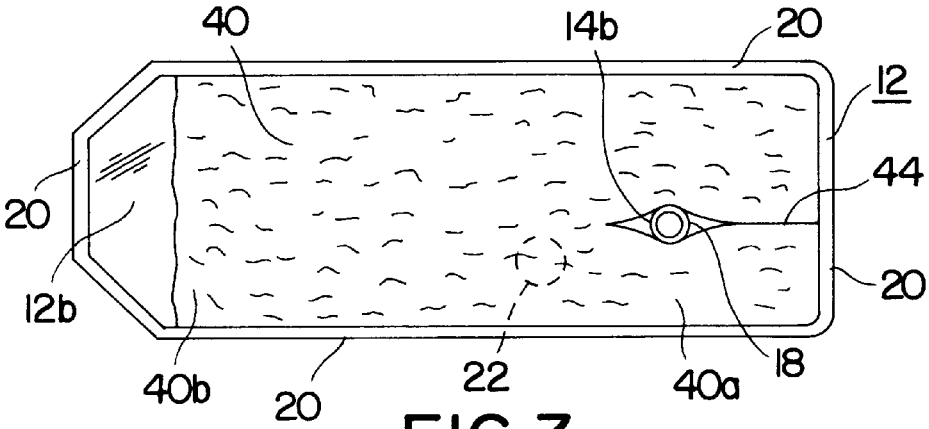
FIG. 3 is a bottom view of the ink refilling adapter.

In addition, an ink absorbing sheet 40 is provided on the under surface 12*b* of the main plate 12. The ink absorbing sheet 40 having a predetermined thickness is a hardened cotton or urethan or a synthetic sponge and is provided so as to cover substantially the entire lower surface 12*b* of the main plate 12 including the observation opening 22 when seen from the lower surface 12*b* side as shown in FIG. 3. The ink absorbing sheet 40 is in contact with the outer surface of the lower portion 14*b* of the conduit 14. Typically, a slit 44 is cut into from one end of the ink absorbing sheet 40 so that the lower portion 14*b* of the conduit 14 comes into contact at two points with both sides of the slit 44 formed in the sheet 40. It can be indeed designed so that the entire outer surface of the lower portion 14*b* of the conduit 14 is in contact with the ink absorbing sheet 40 via, for instance, a hole (not shown) opened in the sheet 40.

The guide collar 16 can be covered by a safety cap 50 as shown in FIG. 1. The safety cap 50 is a flat cylinder having a top 50*a* and a side wall 50*b* with an ink absorbing material 52 secured to the under surface of the top 50*a*. The ink absorbing material 52 is a cotton, urethane, etc. which is hardened and shaped into, for example, a cubic, cylinder or rectangular form. In other words, the ink absorbing material 52 has a sufficient thickness that can cover the upper portion 14*a* of the conduit 14 so that the upper portion 14*b* can penetrate into the ink absorbing material 52 when the cap 50 is put on the guide collar 16.

Figure 5:
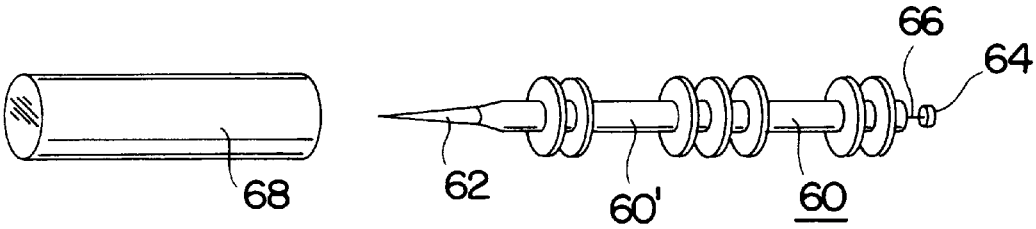
FIG. 5 shows a plug remover tool that is used with the ink refilling adapter of FIG. 1.

The ink refilling adapter 10 described above can be used together with a plug remover tool 60 as shown in FIG. 5. The plug remover tool 60 is made of plastic and has a needle 62, which is metal, at one end of the main section 60' and a replacement plug 64 at another end of the main section 60'. The replacement plug 64 is formed integral to the main section 60' with a thin connecting section 66 in between. The needle 62 is covered by a cap 68.

The needle 62 of the plug remover tool 60 is for removing an original sealing plug 30 which seals the ink inlet 50' of the ink cartridge 50; and the replacement plug 64 is inserted into the ink inlet 50', after the original plug 30 has been removed and the ink refilling is competed (as described below), by being twisted off from the main section 60' of the plug remover tool 60. The thus removed replacement plug 64 remains inside the ink inlet 50' so as to seal the ink inlet 50'.

In use, an empty ink cartridge 50 is placed on a flat surface. It can be placed in a ink cartridge holding box as disclosed in the U.S. patent application Ser. No. 08/408,916.

The sealing plug 30 installed in the ink inlet 50' of the cartridge 50 is removed. The plug 30 can be removed by piercing the needle 62 of the plug remover tool 60 into the sealing plug 30 and pulling the plug 30 out of the ink inlet 50'. The sealing plug 30 can be removed from the ink inlet 50' with any other appropriate tools and/or methods.

Then, the ink refill adapter 10 is placed on the cartridge 50 by inserting the lower portion 14*b* of the conduit into the ink inlet 50' and placing the lower surface 12*b* (or the ink absorbing sheet 40) of the main plate 12 on the top wall 52 of the cartridge 50. The safety cap 50 is removed from the guide collar 16.

An ink outlet 102 of the ink container 100 is inserted inside the guide collar 16 of the adapter 10 so that the pointed upper end 14*a'* of the upper portion 14*a* of the conduit 14 breaks through the ink outlet 102 of the ink container 100. Since the ink outlet 102 is supported by the guide collar 16, the ink container 100 can stand still on the adapter 10. As a result, the ink inside the ink container 100 flows due to gravity into central bore 14' of the conduit 14; and the ink flows out of the conduit 14 through the vertical slit 18 formed in the lower portion 14*b* of the conduit 14 and is absorbed by the ink absorption material 54 installed in the cartridge 50.

If an excess amount of ink is transferred into the cartridge 50 and the ink absorption material 54 is saturated with ink, the ink overflows and goes up along the outside surface of the lower portion 14*b* of the conduit 14. When the ink reaches the top end of the lower portion 14*b* of the conduit 14, since the ink absorbing sheet 40 is in contact with the outer surface of the lower portion 14*b* of the conduit 14, the ink is absorbed by the ink absorbing sheet 40. The absorbed ink spreads from one end area 40*a* toward another end area 40*b;* and this spreading of the ink is seen through the ink observation opening 22. Accordingly, when the ink is thus seen through the observation opening 22, the ink outlet 102 of the ink container 100 is removed from the upper portion 14*a* of the conduit 14 and taken out of the guide collar 16 so as to terminate the ink refilling operation.

After the completion, the safety cap 50 is placed back on the guide collar 16, and then the adapter 10 is removed from the cartridge 50. The replacement plug 64 of the plug remover tool 60 is pushed into the ink inlet 50' of the cartridge 50 and twisted off from the plug remover tool 70 by being separated from the connecting section 66, thus remaining in the ink inlet 50' and sealing the ink inlet 50 of the cartridge 50. The cartridge 50 is thus ready to be installed back in an ink jet printer.

As seen from above, according to the present invention, the overflow of ink from the ink cartridge during the ink refilling operation is recognized at the beginning of such overflow through the ink observation opening. Accordingly, ink refilling can be stopped immediately or at the very early stage of the overflowing of the ink, thus preventing contamination of the ink refilling environment.

I claim:

1. An ink refilling assembly for refilling an ink cartridge with ink from a separate ink container through an ink inlet of said ink cartridge, said ink refilling assembly comprising:

a main plate having a first surface and a second surface;

an ink transfer means for transferring ink from said separate ink container to said ink cartridge, said ink transfer means having a central bore therein and provided so as to pass through said main plate, said ink transfer means having a first side portion and a second side portion which is opposite from said first side portion, said first side portion extending from said first surface of said main plate and said second side portion extending from said second surface of said main plate;

an ink absorbing means for absorbing excess ink transferred to said ink cartridge, said ink absorbing means being provided on said second surface of said main plate; and an ink observation means for observing said absorbed excess ink in said ink absorbing means, said ink observation means comprising an opening in said main plate.

2. An ink refilling assembly according to claim 1, further comprising side walls extending at right angles from edges of said main plate so as to surround said second surface.

3. An ink refilling assembly according to claim 1, further comprising a cylindrical portion formed on said first surface of said main plate, said cylindrical portion surrounding said first side portion of said central bore.

4. An ink refilling assembly according to claim 1, wherein said ink absorbing means is in contact with an outer surface of said second side portion of said central bore.

5. An ink refilling assembly according to claim 1, wherein said ink absorbing means covers substantially all of said second surface of said main plate.

6. An ink refilling adapter for refilling an ink cartridge with ink from a separate ink container through an ink inlet of said ink cartridge, said adapter comprising:

a main plate having substantially a same shape as one outer surface of said cartridge;

an ink transfer conduit provided in said main plate so as to pass through said main plate, said ink transfer conduit having a first side portion and a second side portion which is opposite from said first side portion, said first side portion extending from one side of said main plate and said second side portion extending from another side of said main plate;

an ink absorbing means for absorbing excess ink transferred to said ink cartridge, said ink absorbing means being provided on said another side of said main plate, said ink absorbing means being in contact with an outer surface of said second side portion of said ink transfer conduit; and a through hole formed in said main plate for observing said absorbed excess ink transferred to said ink cartridge.

7. A device for refilling an ink cartridge with ink from a separate ink container through an ink inlet of said ink cartridge, said device comprising:

an ink refilling adapter comprising:

a main plate placed on said ink cartridge, an ink transfer conduit passing through said main plate, said ink transfer conduit having an upper portion and a lower portion which is opposite from said upper portion, said upper portion extending from one side of said main plate and said lower portion extending from another side of said main plate, an ink absorbing means for absorbing excess ink transferred to said ink cartridge, said ink absorbing means being provided on said another side of said main plate, and an ink observation opening provided in said main plate for observing said absorbed excess ink in said ink absorbing means transferred to said ink cartridge; and a plug remover tool having at one end thereof a pointed end and at another end thereof a replacement plug, said pointed end for removing a first plug which seals said ink inlet of said ink cartridge and said replacement plug being inserted in said ink inlet after said first plug is removed and then separated from said plug remover tool so as to seal said ink inlet.

* * * * *